US010748489B2

(12) United States Patent
Ling et al.

(10) Patent No.: US 10,748,489 B2
(45) Date of Patent: Aug. 18, 2020

(54) PIXEL DRIVING CIRCUIT AND DRIVING METHOD THEREOF, AND DISPLAY APPARATUS

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Jie Ling, Beijing (CN); Feng Liu, Beijing (CN); Wenjian Wang, Beijing (CN); Liangming Luo, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 16/229,727

(22) Filed: Dec. 21, 2018

(65) Prior Publication Data

US 2019/0244568 A1 Aug. 8, 2019

(30) Foreign Application Priority Data

Feb. 6, 2018 (CN) ..... 2018 1 0117536

(51) Int. Cl.
*G09G 3/3258* (2016.01)

(52) U.S. Cl.
CPC ... *G09G 3/3258* (2013.01); *G09G 2300/0819* (2013.01); *G09G 2320/045* (2013.01)

(58) Field of Classification Search
CPC .. G09G 3/3258; G09G 3/3233; G09G 3/3255; G09G 2300/0819; G09G 2300/0814; G09G 2320/045
(Continued)

(56) References Cited

U.S. PATENT DOCUMENTS 8,462,086 B2 * 6/2013 Takasugi ..... G09G 3/3233 345/76
9,448,676 B2 * 9/2016 Zhou ..... G06F 3/0412
(Continued)

FOREIGN PATENT DOCUMENTS

CN 202855270 U 4/2013
CN 104715726 A 6/2015
(Continued)

OTHER PUBLICATIONS

First Office Action dated Jun. 18, 2019 corresponding to Chinese application No. 201810117536.X.

*Primary Examiner* — Jason M Mandeville
(74) *Attorney, Agent, or Firm* — Nath, Goldberg & Meyer; Joshua B. Goldberg

(57) ABSTRACT

A pixel driving circuit and a driving method therefor are provided. The pixel driving circuit includes a turn-on voltage acquiring device, a compensation device, a light-emitting controller, a data writing device, a driving transistor and a light emitting device. The turn-on voltage acquiring device acquires a turn-on voltage of the light emitting device and generates a compensation signal according to the turn-on voltage; the data writing device provides a data voltage to the gate of the driving transistor; the light-emitting controller provides a first operating voltage to a first electrode of the driving transistor; and the compensation device generates a control signal according to the compensation signal, the data voltage and the threshold voltage of the driving transistor and provides the control signal to the gate of the driving transistor; the driving transistor outputs a driving current to the light emitting device.

20 Claims, 4 Drawing Sheets

(58) Field of Classification Search
USPC ..... 345/214, 76
See application file for complete search history.

(56) References Cited

U.S. PATENT DOCUMENTS

| | | | | |
|---|---|---|---|---|
| 2004/0257353 | A1* | 12/2004 | Imamura | G09G 3/3233 345/204 |
| 2007/0273618 | A1* | 11/2007 | Hsieh | G09G 3/3233 345/76 |
| 2011/0285691 | A1* | 11/2011 | Takasugi | G09G 3/3233 345/212 |
| 2014/0191669 | A1* | 7/2014 | Tan | G09G 3/3233 315/172 |

FOREIGN PATENT DOCUMENTS

| | | | |
|---|---|---|---|
| CN | 104867441 | A | 8/2015 |
| CN | 105139807 | A | 12/2015 |
| JP | 200429219 | A | 1/2004 |

* cited by examiner

PIXEL DRIVING CIRCUIT AND DRIVING METHOD THEREOF, AND DISPLAY APPARATUS

CROSS-REFERENCE TO RELATED APPLICATION

The present disclosure claims the priority of Chinese patent application No. 201810117536.X filed on Feb. 6, 2018, contents of which are hereby incorporated by reference.

TECHNICAL FIELD

The present disclosure relates to the field of display technology, in particular to a pixel driving circuit, a driving method of the pixel driving circuit and a display apparatus.

BACKGROUND

Active Matrix Organic Light Emitting Diode (AMOLED) panels have been widely used. Pixel display device of AMOLED is an organic light-emitting diode (OLED). Light emitting of AMOLED is realized by driving a thin-film transistor to generate a driving current in a saturation state, and then the driving current drives the OLED to emit light.

SUMMARY

The present disclosure provides a pixel driving circuit includes a turn-on voltage acquiring device, a compensation device, a light-emitting controller, a data writing device, a driving transistor and a light emitting device, the turn-on voltage acquiring device is coupled to a first electrode and a second electrode of the light emitting device, and the compensation device, and is configured to generate a compensation signal according to a turn-on voltage under control of a first control signal provided by a first control signal line and a second control signal provided by a second control signal line, and to provide the compensation signal to the compensation device, the turn-on voltage is a voltage difference between the first electrode and the second electrode of the light emitting device when the light emitting device is in an on-state, the data writing device is coupled to a gate of the driving transistor, and is configured to provide a data voltage to the gate of the driving transistor under control of a third control signal provided by a third control signal line, the light-emitting controller is coupled to a first electrode of the driving transistor, and is configured to provide a first operating voltage to the first electrode of the driving transistor under control of a light-emitting control signal provided by a light-emitting control signal line, the compensation device is coupled to the gate of the driving transistor and the first electrode of the light emitting device, and is configured to generate a control signal according to the compensation signal, the data voltage and a threshold voltage of the driving transistor under control of the third control signal provided by the third control signal line and a fourth control signal provided by a fourth control signal line, and to provide the control signal to the gate of the driving transistor, a second electrode of the driving transistor is coupled to the first electrode of the light emitting device, and is configured to output a driving current to the light emitting device to drive the light emitting device to emit light.

In some implementations, a voltage of the compensation signal is equal to Vss−Voled, where Vss is a second operating voltage input to the second electrode of the light emitting device and Voled is the turn-on voltage.

In some implementations, a voltage of the control signal is equal to Vss−Voled+Vdd−Vdata−|Vth|, where Vss is the second operating voltage input to the light emitting device, Voled is the turn-on voltage, Vdd is the first operating voltage, Vdata is the data voltage, and Vth is the threshold voltage of the driving transistor.

In some implementations, the turn-on voltage acquiring device includes a first transistor, a second transistor, a third transistor and a first capacitor, a control electrode of the first transistor is coupled to the first control signal line, a first electrode of the first transistor is coupled to the second electrode of the driving transistor and the first electrode of the light emitting device, and a second electrode of the first transistor is coupled to a first end of the first capacitor and a first electrode of the third transistor, a control electrode of the second transistor is coupled to the first control signal line, a first electrode of the second transistor is coupled to a second end of the first capacitor and the compensation device, and a second electrode of the second transistor is coupled to a second power supply terminal, a control electrode of the third transistor is coupled to the second control signal line, the first electrode of the third transistor is coupled to the first end of the first capacitor, and a second electrode of the third transistor is coupled to the second power supply terminal.

In some implementations, the compensation device includes a fourth transistor, a fifth transistor and a second capacitor, a control electrode of the fourth transistor is coupled to the third control signal line, a first electrode of the fourth transistor is coupled to the turn-on voltage acquiring device, and a second electrode of the fourth transistor is coupled to a first electrode of the fifth transistor and a first end of the second capacitor, a control electrode of the fifth transistor is coupled to the fourth control signal line, the first electrode of the fifth transistor is coupled to the first end of the second capacitor, and a second electrode of the fifth transistor is coupled to the control electrode of the driving transistor, a second end of the second capacitor is coupled to the first electrode of the driving transistor.

In some implementations, the data writing device includes a sixth transistor, a control electrode of the sixth transistor is coupled to the third control signal line, a first electrode of the sixth transistor is coupled to a data line, and a second electrode of the sixth transistor is coupled to the control electrode of the driving transistor.

In some implementations, the light-emitting controller includes a seventh transistor, a control electrode of the seventh transistor is coupled to the light-emitting control signal line, a first electrode of the seventh transistor is coupled to a first power supply terminal, and a second electrode of the seventh transistor is coupled to the first electrode of the driving transistor.

In some implementations, each of transistors in the pixel driving circuit is a P-type transistor.

The present disclosure provides a display apparatus including the above pixel driving circuit.

The present disclosure provides a driving method for the above pixel driving circuit, the method includes a turn-on voltage acquiring stage, a data writing stage, a threshold compensation stage and a display stage, in the turn-on voltage acquiring stage, the turn-on voltage acquiring device acquires the turn-on voltage under the control of the first control signal and the second control signal, and generates the compensation signal according to the turn-on voltage; in the data writing stage, the turn-on voltage acquiring device provides the compensation signal to the compensation device, and the data writing device provides the data voltage to the gate of the driving transistor under the control of the third control signal; in the threshold compensation stage, the compensation device generates the control signal according to the compensation signal, the data voltage and the threshold voltage of the driving transistor under the control of the third control signal and the fourth control signal; in the display stage, the compensation device provides the control signal to the driving transistor, the light-emitting controller provides the first operating voltage to the first electrode of the driving transistor under the control of the light-emitting control signal, the driving transistor generates the driving current under a combined action of the first operating voltage and the control signal to drive the light emitting device to emit light.

In some implementations, the turn-on voltage acquiring device includes a first transistor, a second transistor, a third transistor and a first capacitor, a control electrode of the first transistor is coupled to the first control signal line, a first electrode of the first transistor is coupled to the second electrode of the driving transistor and the first electrode of the light emitting device, and a second electrode of the first transistor is coupled to a first end of the first capacitor and a first electrode of the third transistor, a control electrode of the second transistor is coupled to the first control signal line, a first electrode of the second transistor is coupled to a second end of the first capacitor and the compensation device, and a second electrode of the second transistor is coupled to a second power supply terminal, a control electrode of the third transistor is coupled to the second control signal line, the first electrode of the third transistor is coupled to the first end of the first capacitor, and a second electrode of the third transistor is coupled to the second power supply terminal, the turn-on voltage acquiring stage includes a first sub-stage, a second sub-stage and a third sub-stage, in the first sub-stage, the light-emitting controller provides a first operating voltage to the first electrode of the driving transistor under the control of the light-emitting control signal, the driving transistor outputs a driving current, and the light emitting device is turned on; the first transistor, the second transistor are turned on under the control of the first control signal, and the third transistor is turned off under the control of the second control signal, the turn-on voltage of the first electrode of the light emitting device is written to the first end of the first capacitor through the first transistor, and the second operating voltage is written to the second end of the first capacitor through the second transistor, in the second sub-stage, the light-emitting control device stops providing the first operating voltage to the first electrode of the driving transistor, the first transistor and the second transistor are maintained being turned on under the control of the first control signal, and the third transistor is maintained being turned off under the control of the second control signal, in the third sub-stage, the first transistor and the second transistor are turned off under the control of the first control signal, the third transistor is turned on under the control of the second control signal, the second operating voltage is written to the first end of the first capacitor through the third transistor, and the second end of the second capacitor provides the compensation signal to the compensation device, a voltage of the compensation signal is equal to Vss−Voled, where Vss is the second operating voltage and Voled is the turn-on voltage.

In some implementations, the compensation device includes a fourth transistor, a fifth transistor and a second capacitor, a control electrode of the fourth transistor is coupled to the third control signal line, a first electrode of the fourth transistor is coupled to the first electrode of the second transistor, and a second electrode of the fourth transistor is coupled to a first electrode of the fifth transistor and a first end of the second capacitor, a control electrode of the fifth transistor is coupled to the fourth control signal line, the first electrode of the fifth transistor is coupled to the first end of the second capacitor, and a second electrode of the fifth transistor is coupled to the control electrode of the driving transistor, a second end of the second capacitor is coupled to the first electrode of the driving transistor; the data writing device includes a sixth transistor, a control electrode of the sixth transistor is coupled to the third control signal line, a first electrode of the sixth transistor is coupled to a data line, and a second electrode of the sixth transistor is coupled to the control electrode of the driving transistor; the light-emitting controller includes a seventh transistor, a control electrode of the seventh transistor is coupled to the light-emitting control signal line, a first electrode of the seventh transistor is coupled to a first power supply terminal, and a second electrode of the seventh transistor is coupled to the first electrode of the driving transistor, in the compensation stage, the third control signal line is controlled so that the fourth transistor is turned on and the data writing device is turned on; the first control signal line, the second control signal line, the fourth control signal line and the light emitting control signal line are controlled so that the first transistor, the second transistor, the third transistor, the fifth transistor and the light emitting controller are turned off, and in the display stage, the fourth signal control signal line and the light-emitting control signal line are controlled so that both the fifth transistor and the seventh transistor are turned on; the first control signal line, the second control signal line, the third control signal line and the fourth control signal line are controlled so that the first transistor, the second transistor, the third transistor, the fourth transistor and the sixth transistor are turned off.

DETAILED DESCRIPTION

To enable those skilled in the art to better understand the technical solutions of the present disclosure, a pixel driving circuit, a driving method for the pixel driving circuit and a display apparatus provided in the present disclosure are described in detail below in conjunction with the accompanying drawings.

Figure 1:
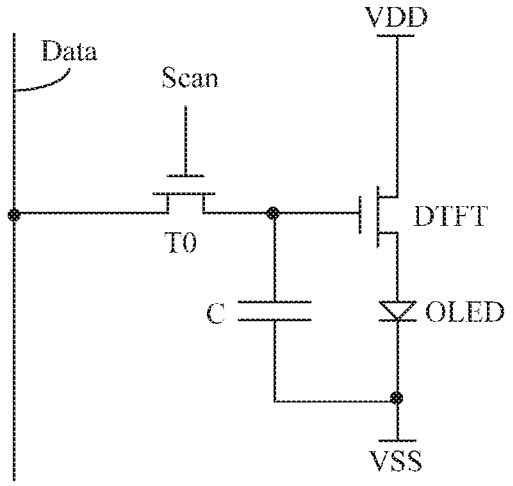
FIG. 1 is a schematic structural diagram of a basic pixel driving circuit in the related art.

FIG. 1 is a schematic structural diagram of a basic pixel driving circuit in the related art. As shown in FIG. 1, the basic pixel driving circuit adopts a 2T1C circuit, which includes two thin film transistors (a switching transistor T0 and a driving transistor DTFT) and one storage capacitor C.

However, in an existing low temperature polycrystalline silicon process, threshold voltages Vth of driving transistors DTFT of a display substrate have poor uniformity and may be drifted during being used, when switching transistors T0 are controlled to be turned on by scanning lines Scan to input a same data voltage Vdata to the driving transistors DTFT, different driving currents are generated due to different threshold voltages of the driving transistors DTFT, resulting to poor brightness uniformity of the OLEDs in the display apparatus.

In addition, with the increase of service time, OLED will be aging, and the turn-on voltage of the OLED will be increased. When the driving current input to the OLED remains unchanged, the actual current flowing through the OLED will be decreased, the actual brightness of the OLED will be decreased, and thus the display quality of the OLED will be decreased.

Figure 2:
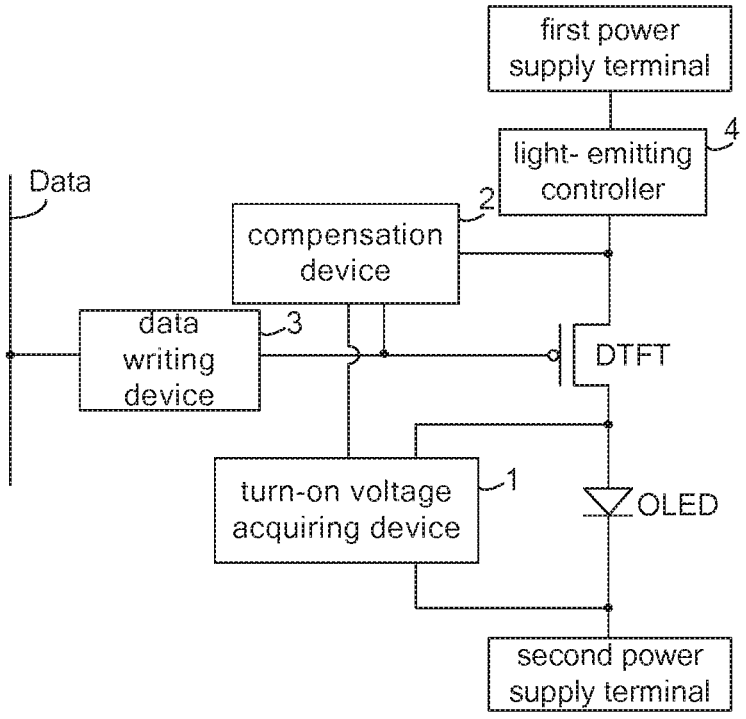
FIG. 2 is a schematic structural diagram of a pixel driving circuit in an embodiment of the present disclosure.

FIG. 2 is a schematic structural diagram of a pixel driving circuit in an embodiment of the disclosure. As shown in FIG. 2, the pixel driving circuit includes a turn-on voltage acquiring device 1, a compensation device 2, a light-emitting controller 4, a data writing device 3, a driving transistor DTFT and a light emitting device OLED.

The turn-on voltage acquiring device 1 is coupled to a first electrode and a second electrode of the light emitting device OLED and the compensation device 2, and is configured to generate a compensation signal according to a turn-on voltage under the control of a first control signal provided by a first control signal line EN1 and a second control signal provided by a second control signal line EN2, and to provide the compensation signal to the compensation device 2, the turn-on voltage is a voltage difference between the first electrode and the second electrode of the light emitting device OLED when the light emitting device OLED is in a turn-on state.

The data writing device 3 is coupled to a gate of the driving transistor DTFT, and is configured to provide a data voltage to the gate of the driving transistor DTFT under the control of a third control signal provided by a third control signal line EN3.

The light-emitting controller 4 is coupled to a first electrode of the driving transistor DTFT, and is configured to provide a first operating voltage to the first electrode of the driving transistor DTFT under the control of a light-emitting control signal provided by a light-emitting control signal line SW.

The compensation device 2 is coupled to the gate of the driving transistor DTFT and the first electrode of the light emitting device OLED, and is configured to generate a control signal according to the compensation signal, the data voltage and a threshold voltage of the driving transistor DTFT under the control of the third control signal provided by the third control signal line EN3 and a fourth control signal provided by a fourth control signal line EN4, and to provide the control signal to the gate of the driving transistor DTFT.

A second electrode of the driving transistor DTFT is coupled to the first electrode of the light emitting device OLED, and is configured to output a driving current to the light emitting device OLED to drive the light emitting device OLED to emit light.

It should be noted that the light emitting device OLED in the present embodiment may be a current-driven light emitting device OLED including a light emitting diode (LED) or an organic light emitting diode (OLED) in the related art. In the present embodiment, the OLED is illustrated as an example.

In the technical solution of the present disclosure, the turn-on voltage acquiring device 1 acquires the turn-on voltage of the light emitting device OLED and generates a corresponding compensation signal, and sends the compensation signal to the compensation device 2, the compensation device 2 generates the control signal according to the compensation signal, the data voltage and the threshold voltage of the driving transistor DTFT, and sends the control signal to the gate of the driving transistor DTFT, so that magnitude of the driving current generated by the driving transistor DTFT is independent of the threshold voltage of the driving transistor DTFT, but positively correlated with the turn-on voltage of the light emitting device OLED. Since the driving current generated by driving transistor DTFT is independent of the threshold voltage of the driving transistor DTFT, the influence of the threshold voltage of driving transistor DTFT on the driving current of the light emitting device OLED can be eliminated, thus the brightness uniformity of the light emitting device OLEDs in the display apparatus can be improved. Meanwhile, since the driving current generated by driving transistor DTFT is positively correlated with the turn-on voltage of the light emitting device OLED, with aging of the light emitting device OLED itself, the turn-on voltage of the light emitting device OLED is increased correspondingly, and in a case where the data voltage maintains unchanged, the driving current output to the OLED by the driving transistor DTFT is increased, which can compensate for the brightness reduction of the light emitting device OLED caused by aging of the light emitting device OLED itself.

It can be seen that the technical solution of the present disclosure can simultaneously solve problem of poor brightness uniformity of the light emitting devices in the display apparatus and the problem of the brightness reduction of each light emitting device due to its aging.

Figure 3:
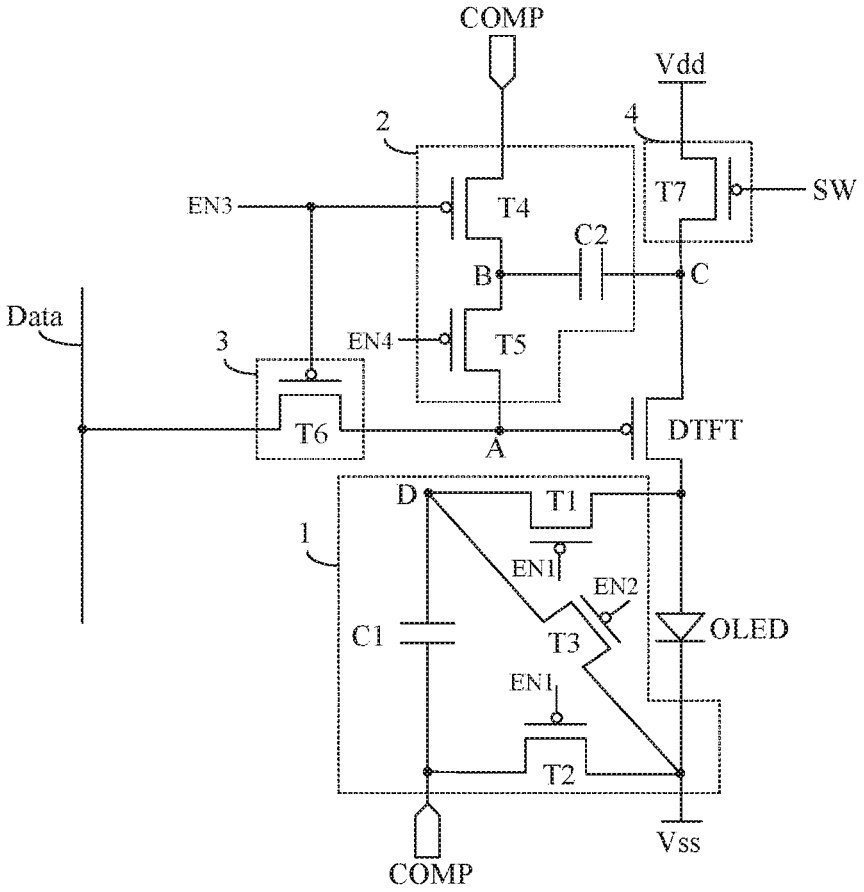
FIG. 3 is a schematic structural diagram of a pixel driving circuit in an embodiment of the present disclosure.

FIG. 3 is a schematic structural diagram of a pixel driving circuit in an embodiment of the present disclosure. As shown in FIG. 3, the pixel driving circuit is a specific implementation based on the pixel driving circuit shown in FIG. 2.

In some specific implementations, the turn-on voltage acquiring device 1 includes a first transistor T1, a second transistor T2, a third transistor T3 and a first capacitor C1.

A control electrode of the first transistor T1 is coupled to the first control signal line EN1, a first electrode of the first transistor T1 is coupled to the second electrode of the driving transistor DTFT and a first electrode of the light emitting device OLED, and a second electrode of the first transistor T1 is coupled to a first end of the first capacitor C1 and a first electrode of the third transistor T3.

A control electrode of the second transistor T2 is coupled to the first control signal line EN1, a first electrode of the second transistor T2 is coupled to a second end of the first capacitor C1 and the compensation device 2, and a second electrode of the second transistor T2 is coupled to a second power supply terminal.

A control electrode of the third transistor T3 is coupled to a second control signal line EN2, a first electrode of the third transistor T3 is coupled to the first end of the first capacitor C1, and a second electrode of the third transistor T3 is coupled to the second power supply terminal.

In some specific implementations, the compensation device 2 includes a fourth transistor T4, a fifth transistor T5 and a second capacitor C2.

A control electrode of the fourth transistor T4 is coupled to a third control signal line EN3, a first electrode of the fourth transistor T4 is coupled to the turn-on voltage acquiring device 1, and a second electrode of the fourth transistor T4 is coupled to a first electrode of the fifth transistor T5 and the first end of the second capacitor C2.

A control electrode of the fifth transistor T5 is coupled to a fourth control signal line EN4, a first electrode of the fifth transistor T5 is coupled to the first end of the second capacitor C2, and a second electrode of the fifth transistor T5 is coupled to the control electrode of the driving transistor DTFT.

A second end of the second capacitor C2 is coupled to the first electrode of the driving transistor DTFT.

In some specific implementations, the data writing device 3 includes a sixth transistor T6.

A control electrode of the sixth transistor T6 is coupled to the third control signal line EN3, a first electrode of the sixth transistor T6 is coupled to a data line Data, and a second electrode of the sixth transistor T6 is coupled to the control electrode of the driving transistor DTFT.

In some specific implementations, the light-emitting controller 4 includes a seventh transistor T7.

A control electrode of the seventh transistor T7 is coupled to a light-emitting control signal line SW, a first electrode of the seventh transistor T7 is coupled to the first power supply terminal, and a second electrode of the seventh transistor T7 is coupled to the first electrode of the driving transistor DTFT.

It should be noted that each of the driving transistor DTFT and the first transistor T1 through the seventh transistor T7 in the present embodiment is one independently selected from a polycrystalline silicon thin film transistor, an amorphous silicon thin film transistor, an oxide thin film transistor and an organic thin film transistor. The first transistor T1 through the seventh transistor T7 are used as switching transistors.

In this embodiment, the "control electrode" specifically refers to a gate of a transistor, the "first electrode" specifically refers to a source of the transistor, and the corresponding "second electrode" specifically refers to a drain of the transistor. Certainly, those skilled in the art should be known that the "first electrode" and the "second electrode" can be interchanged.

In the present embodiment, all transistors in the pixel driving circuit are P-type transistors, in this case, a same manufacturing process may be used to simultaneously manufacture the transistors, thereby shortening the production cycle of the pixel driving circuit. It should be noted that all transistors in the pixel driving circuit being P-type thin film transistors is only an example of the present embodiment, and does not limit the technical solution of the present disclosure.

Operating process of the pixel driving circuit provided in the present embodiment will be described in detail below in conjunction with the drawings. In the following description, the driving transistor DTFT and the first transistor T1 through transistor T7 being P-type thin film transistors are taken as an example. The first power supply terminal provides a first operating voltage Vdd, and the second power supply terminal provides a second operating voltage Vss. In the present embodiment, Vss is used as a reference voltage and Vss=0V. The threshold voltage Vth of the driving transistor DTFT is negative.

In addition, for the convenience of description, the connection node for connecting the turn-on voltage acquiring device 1 with the compensation device 2 is called a signal transmission terminal COMP.

Figure 4:
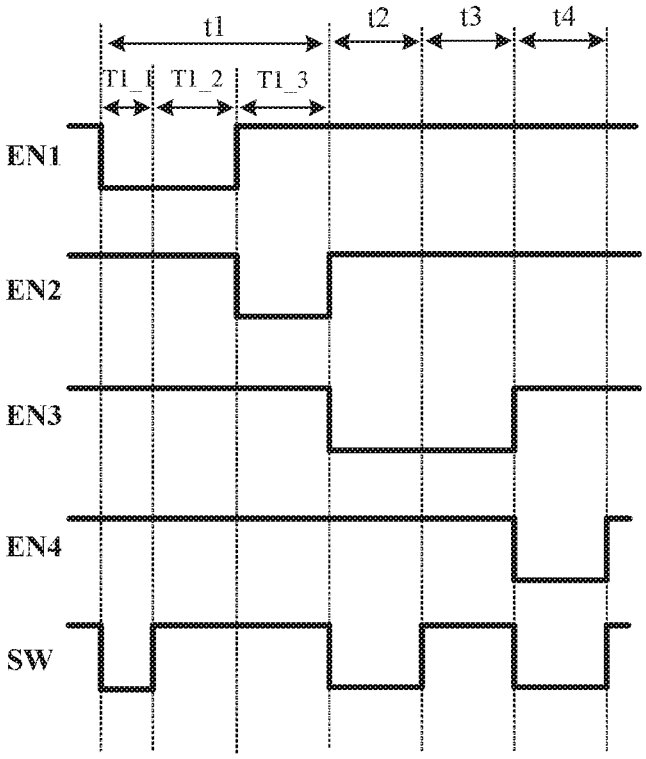
FIG. 4 is a timing diagram of operation of the pixel driving circuit shown in FIG. 3.

FIG. 4 is a timing diagram of operation of the pixel driving circuit shown in FIG. 3, as shown in FIG. 4, the operating process of the pixel driving circuit includes three stages: a turn-on voltage reading stage t1, a data writing stage t2, a compensation stage T3 and a display stage t4.

In the turn-on voltage reading stage t1, the turn-on voltage acquiring device 1 provides a compensation signal to the compensation device 2 under the control of the first control signal and the second control signal. Specifically, the turn-on voltage reading stage includes a first sub-stage t1_1, a second sub-stage t1_2 and a third sub-stage t1_3.

In the first sub-stage t1_1, the first control signal output by the first control signal line EN1 is at a low level, the second control signal output by the second control signal line EN2 is at a high level, the third control signal output by the third control signal line EN3 is at a high level, the fourth control signal output by the fourth control signal line EN4 is at a high level, and the light-emitting control signal output by the light-emitting control signal line SW is at a low level. At this time, the first transistor T1, the second transistor T2 and the seventh transistor T7 are turned on, while the third transistor T3, the fourth transistor T4, the fifth transistor T5 and the sixth transistor T6 are turned off.

Since the seventh transistor T7 is turned on, the first operating voltage Vdd is written to the first electrode of the driving transistor DTFT through the seventh transistor T7. At this time, the driving transistor DTFT outputs a current, the light emitting device OLED is in a turn-on state, a voltage of the first electrode of the light emitting device OLED is Vss+Voled, and a voltage of the second electrode of the light emitting device OLED is Vss. Since both the first transistor T1 and the second transistor T2 are turned on, the voltage of the second electrode of light emitting device OLED is written to the first end of the first capacitor C1 through the first transistor T1, the voltage of the first electrode of light emitting device OLED is written to the second end of the first capacitor C1 through the second transistor T2, that is, the voltage VD of the point D is equal to Vss+Voled, and the voltage of the signal transmission terminal COMP is Vss.

It should be noted that since duration of the first sub-stage is very short, the user cannot observe mis-light-emitting of the light emitting device OLED.

In the second sub-stage t1_2, the first control signal output by the first control signal line EN1 is at a low level, the second control signal output by the second control signal line EN2 is at a high level, the third control signal output by the third control signal line EN3 is at a high level, the fourth control signal output by the fourth control signal line EN4 is at a high level, and the light-emitting control signal output by the light-emitting control signal line SW is at a high level. At this time, the first transistor T1 and the second transistor T2 are turned on, and the third transistor T3, the fourth transistor T4, the fifth transistor T5, the sixth transistor T6 and the seventh transistor T7 are turned off.

Since the seventh transistor T7 is turned off, the driving transistor DTFT stops outputting the current, both ends of the first capacitor C1 maintains the voltage at the previous sub-stage.

In the third sub-stage t1_3, the first control signal output by the first control signal line EN1 is at a high level, the second control signal output by the second control signal line EN2 is at a low level, the third control signal output by the third control signal line EN3 is at a high level, the fourth control signal output by the fourth control signal line EN4 is at a high level, and the light-emitting control signal output by the light-emitting control signal line SW is at a high level. At this time, the third transistor T3 is turned on, and the first transistor T1, the second transistor T2, the fourth transistor T4, the fifth transistor T5, the sixth transistor T6 and the seventh transistor T7 are turned off.

Since the third transistor T3 is turned on, the first transistor T1 is turned off, the second operating voltage Vss is written to the first end of the first capacitor C1 through the third transistor T3. Furthermore, since the second transistor T2 and the fourth transistor T4 are turned off, the second end of the first capacitor C1 is in a floating state, at this time, the voltage of the second end of the second capacitor C2 jumps to Vss−Voled due to the bootstrapping effect of the capacitor. That is, the voltage VD of the point D is equal to Vss, and the voltage of the signal transmission terminal COMP (i.e., the voltage of the compensation signal) is equal to Vss−Voled.

In the data writing stage t2, the first control signal output by the first control signal line EN1 is at a high level, the second control signal output by the second control signal line EN2 is at a high level, the third control signal output by the third control signal line EN3 is at a low level, the fourth control signal output by the fourth control signal line EN4 is at a high level, and the light-emitting control signal output by the light-emitting control signal line SW is at a low level. At this time, the fourth transistor T4, the sixth transistor T6 and the seventh transistor T7 are all in turn-on state, while the first transistor T1, the second transistor T2, the third transistor T3 and the fifth transistor T5 are all in turn-off state.

Since the fourth transistor T4 is turned on, the voltage at the second end of the first capacitor C1 is written to the first end of the second capacitor C2 (i.e., the compensation signal is written to the compensation device) through the signal transmission terminal COMP and the fourth transistor T4. The voltage VB at point B is equal to Vss−Voled. Since the seventh transistor T7 is turned on, the first operating voltage Vdd is written to point C through the seventh transistor T7, the voltage VC of the point C is equal to Vdd, and a voltage difference between the two ends of the second capacitor C2 is equal to Vss−Voled−Vdd.

Furthermore, since the sixth transistor T6 is turned on, the data voltage is written to the gate of the driving transistor DTFT through the sixth transistor T6, that is, the voltage VA of point A is equal to Vdata.

In the compensation stage t3, the first control signal output by the first control signal line EN1 is at a high level, the second control signal output by the second control signal line EN2 is at a high level, the third control signal output by the third control signal line EN3 is at a low level, the fourth control signal output by the fourth control signal line EN4 is at a high level, and the light-emitting control signal output by the light-emitting control signal line SW is at a high level. At this time, the fourth transistor T4 and the sixth transistor T6 are turned on, and the first transistor T1, the second transistor T2, the third transistor T3, the fifth transistor T5 and the seventh transistor T7 are turned off.

Since the sixth transistor T6 is still maintained being turned on, the voltage VA of the point A is maintained at Vdata. Since the seventh transistor T7 is turned off, the first power supply terminal cannot charge the point C any longer, the point C discharges through the driving transistor DTFT until the gate-source voltage Vgs, which is equal to VA−VC, of the driving transistor DTFT is equal to Vth, that is, the voltage VC of the point C is equal to Vdata+|Vth|.

Since the fourth transistor T4 is turned on, the voltage VB of the point B is maintained at Vss−Voled, and the voltage difference between the two ends of the second capacitor C2 is equal to Vss−Voled−Vdata−|Vth|.

In the display stage t4, the first control signal output by the first control signal EN1 is at a high level, the second control signal output by the second control signal line EN2 is at a high level, the third control signal output by the third control signal line EN3 is at a high level, the fourth control signal output by the fourth control signal line EN4 is at a low level, and the light-emitting control signal output by the light-emitting control signal line SW is at a low level. At this time, both the fifth transistor T5 and the seventh transistor T7 are turned on, and the first transistor T1, the second transistor T2, the third transistor T3, the fourth transistor T4 and the sixth transistor T6 are turned off.

Since the seventh transistor T7 is turned on, the first operating voltage Vdd is written to the point C through the seventh transistor T7. Since the fourth transistor T4 and the sixth transistor T6 are turned off, the point B is in a floating state, and the voltage of the point B jumps to Vss−Voled+Vdd−Vdata−|Vth| (i.e., a control signal is generated) through the bootstrapping effect of the capacitor.

Since the fifth transistor T5 is turned on, the voltage of the point B is written to the point A through the fifth transistor T5 (i.e., the control signal is written to the gate of the driving transistor DTFT), at this tune, the voltage VA is equal to Vss−Voled+Vdd−Vdata−|Vth|.

According to the saturated driving current formula of DTFT, it can be concluded that:

$$
\begin{aligned}
I &= K*(Vgs - Vth)^2 \\
&= K*(\mathrm{VA} - VC - Vth)^2 \\
&= K*(Vss - Voled + Vdd - Vdata - |Vth| - Vdd - Vth)^2 \\
&= K*(Vss - Voled + Vdd - Vdata + Vth - Vdd - Vth)^2 \\
&= K*(Vss - Voled - Vdata)^2
\end{aligned}
$$

where Vss is a reference voltage of 0V, then $I=K*(Voled+Vdata)^2$, and where K is a constant, which is related to the channel characteristics of the driving transistor DTFT.

From the above formula, it can be seen that the driving current of the driving transistor DTFT is independent of the threshold voltage Vth of the driving transistor DTFT, but positively correlated with the turn-on voltage Voled of the light emitting device OLED. Since the driving current I generated by driving transistor DTFT is independent of the threshold voltage Vth of driving transistor DTFT, the influence of the threshold voltage Vth of driving transistor DTFT on the driving current I of the light emitting device OLED can be eliminated, and the brightness uniformity of the light emitting device OLED in the display apparatus can be improved. Meanwhile, the driving current I generated by the driving transistor DTFT is positively correlated with the turn-on voltage Voled of the light emitting device OLED, with aging of the light emitting device OLED itself, the turn-on voltage Voled is increased correspondingly, and the driving current I of the driving transistor DTFT output to the light emitting device OLED is also increased (under the condition of data voltage Vdata unchanged), which can compensate for the brightness reduction of the light emitting device OLED caused by aging of the light emitting device OLED itself.

In addition, in the present disclosure, the first power supply terminal directly charges the second capacitor, and the second power supply terminal directly charges the first capacitor, which can shorten charging time and effectively solve the problem that the charging time is too long due to a low current in low gray scale.

An embodiment of the present disclosure provides a display apparatus including the pixel driving circuit provided in the above embodiments, detail description of which may refer to the contents of the above embodiments, and will not be repeated here.

Figure 5:
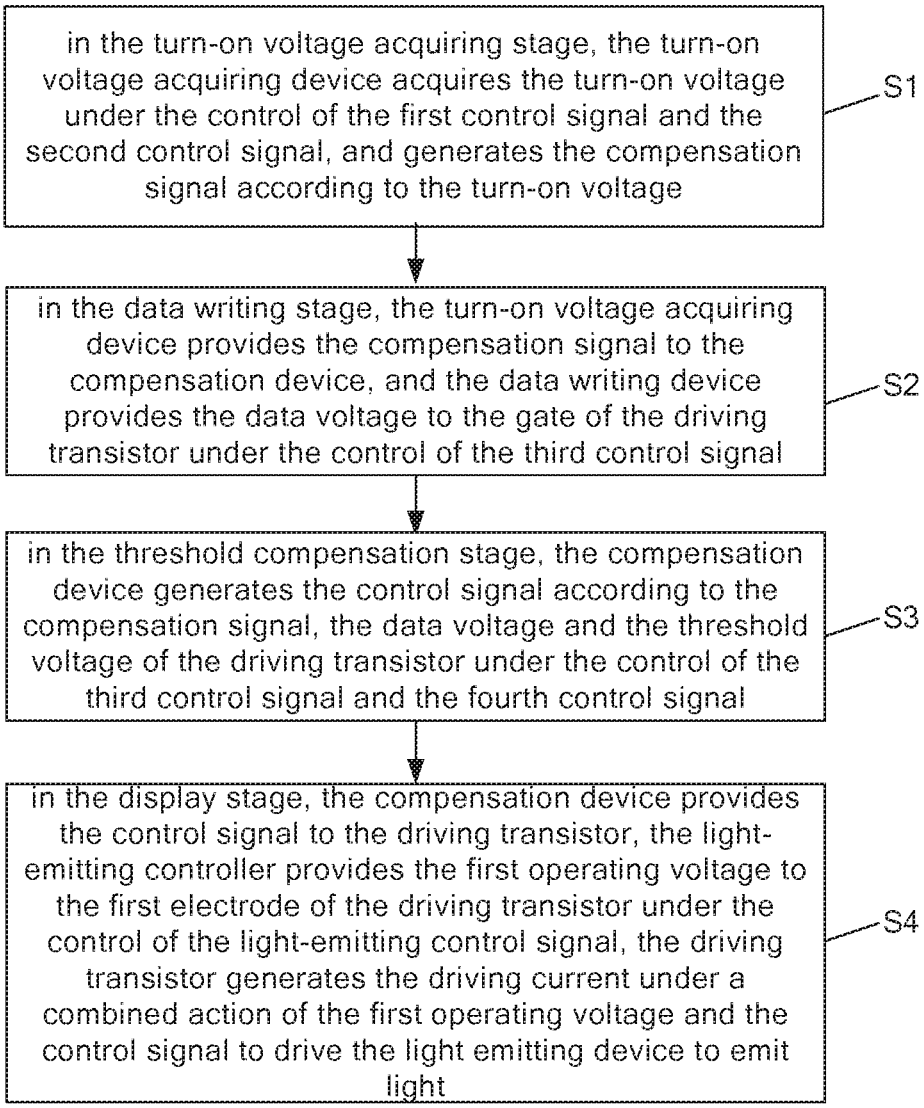
FIG. 5 is a flowchart of a driving method for a pixel driving circuit in an embodiment of the present disclosure.

FIG. 5 is a flow chart of a driving method for a pixel driving circuit in an embodiment of the present disclosure, as shown in FIG. 5, the pixel driving circuit is the pixel driving circuit provided by the above embodiments, and the driving method for the pixel driving circuit includes following steps S1 to S4.

At the step S1, in the turn-on voltage acquiring stage, the turn-on voltage acquiring device acquires the turn-on voltage under the control of the first control signal and the second control signal, and generates the compensation signal according to the turn-on voltage.

In some specific implementations, when the turn-on voltage acquiring device is the turn-on voltage acquiring device in the pixel driving circuit provided by the above embodiment described with reference to FIG. 3, the turn-on voltage acquiring stage includes a first sub-stage, a second sub-stage and a third sub-stage.

In the first sub-stage, the light-emitting controller provides a first operating voltage to the first electrode of the driving transistor under the control of the light-emitting control signal, the driving transistor outputs a driving current, and the light emitting device is turned on; the first transistor, the second transistor are turned on under the control of the first control signal, and the third transistor is turned off under the control of the second control signal, the turn-on voltage of the first electrode of the light emitting device is written to the first end of the first capacitor through the first transistor, and the second operating voltage is written to the second end of the first capacitor through the second transistor.

In the second sub-stage, the light-emitting control device stops providing the first operating voltage to the first electrode of the driving transistor, the first transistor and the second transistor are maintained being turned on under the control of the first control signal, and the third transistor is maintained being turned off under the control of the second control signal.

In the third sub-stage, the first transistor and the second transistor are turned off under the control of the first control signal, the third transistor is turned on under the control of the second control signal, the second operating voltage is written to the first end of the first capacitor through the third transistor, and the second end of the second capacitor provides the compensation signal to the compensation device, a voltage of the compensation signal is equal to Vss−Voled, where Vss is the second operating voltage and Voled is the turn-on voltage.

At the step S2, in the data writing stage, the turn-on voltage acquiring device provides the compensation signal to the compensation device, and the data writing device provides the data voltage to the gate of the driving transistor under the control of the third control signal.

At the step S3, in the threshold compensation stage, the compensation device generates the control signal according to the compensation signal, the data voltage and the threshold voltage of the driving transistor under the control of the third control signal and the fourth control signal.

At the step S4, in the display stage, the compensation device provides the control signal to the driving transistor, the light-emitting controller provides the first operating voltage to the first electrode of the driving transistor under the control of the light-emitting control signal, the driving transistor generates the driving current under a combined action of the first operating voltage and the control signal to drive the light emitting device to emit light.

For the specific description of the above steps S1-S4, reference can be made to the corresponding contents of the above embodiments, which will not be repeated here.

The present disclosure has the following beneficial effects.

The present disclosure provides a pixel driving circuit and a driving method therefor, and a display apparatus. The turn-on voltage acquiring device acquires the turn-on voltage of the light emitting device and generates a corresponding compensation signal, and sends the compensation signal to the compensation device, the compensation device generates the control signal according to the compensation signal, the data voltage and the threshold voltage of the driving transistor, and sends the control signal to the gate of the driving transistor, so that magnitude of the driving current generated by the driving transistor is independent of the threshold voltage of the driving transistor, but positively correlated with the turn-on voltage of the light emitting device. Since the driving current generated by driving transistor is independent of the threshold voltage of driving transistor, the influence of the threshold voltage of driving transistor on the driving current of the light emitting device can be eliminated, thus the brightness uniformity of the light emitting devices in the display apparatus can be improved. Meanwhile, since the driving current generated by driving transistor is positively correlated with the turn-on voltage of the light emitting device, with aging of the light emitting device itself, the turn-on voltage is increased correspondingly, and in a case where the data voltage is maintained being unchanged, the driving current output to the light emitting device by the driving transistor is increased, which can compensate for the brightness reduction of the light emitting device caused by aging of the light emitting device itself.

It should be understood that, the foregoing embodiments are only exemplary embodiments used for explaining the principle of the present disclosure, but the present disclosure is not limited thereto. Various variations and improvements may be made by a person skilled in the art without departing from the spirit and essence of the present disclosure, and these variations and improvements also fall into the protection scope of the present disclosure.

The invention claimed is:

1. A pixel driving circuit, comprising a turn-on voltage acquiring device, a compensation device, a light-emitting controller, a data writing device, a driving transistor and a light emitting device, wherein the turn-on voltage acquiring device is coupled to a first electrode and a second electrode of the light emitting device, and the compensation device, and is configured to generate a compensation signal according to a turn-on voltage under control of a first control signal provided by a first control signal line and a second control signal provided by a second control signal line, and to provide the compensation signal to the compensation device, the turn-on voltage is a voltage difference between the first electrode and the second electrode of the light emitting device when the light emitting device is in an on-state, the data writing device is coupled to a gate of the driving transistor, and is configured to provide a data voltage to the gate of the driving transistor under control of a third control signal provided by a third control signal line, the light-emitting controller is coupled to a first electrode of the driving transistor, and is configured to provide a first operating voltage to the first electrode of the driving transistor under control of a light-emitting control signal provided by a light-emitting control signal line, the compensation device is coupled to the gate of the driving transistor and the first electrode of the driving transistor, and is configured to generate a control signal according to the compensation signal, the data voltage and a threshold voltage of the driving transistor under the control of the third control signal provided by the third control signal line and a fourth control signal provided by a fourth control signal line, and to provide the control signal to the gate of the driving transistor, a second electrode of the driving transistor is coupled to the first electrode of the light emitting device, and is configured to output a driving current to the light emitting device to drive the light emitting device to emit light.

2. The pixel driving circuit of claim 1, wherein a voltage of the compensation signal is equal to Vss−Voled, where Vss is a second operating voltage input to the second electrode of the light emitting device and Voled is the turn-on voltage.

3. The pixel driving circuit of claim 1, wherein a voltage of the control signal is equal to Vss−Voled+Vdd−Vdata−|Vth|, where Vss is the second operating voltage input to the light emitting device, Voled is the turn-on voltage, Vdd is the first operating voltage, Vdata is the data voltage, and Vth is the threshold voltage of the driving transistor.

4. The pixel driving circuit of claim 1, wherein the turn-on voltage acquiring device comprises a first transistor, a second transistor, a third transistor and a first capacitor, wherein a control electrode of the first transistor is coupled to the first control signal line, a first electrode of the first transistor is coupled to the second electrode of the driving transistor and the first electrode of the light emitting device, and a second electrode of the first transistor is coupled to a first end of the first capacitor and a first electrode of the third transistor, a control electrode of the second transistor is coupled to the first control signal line, a first electrode of the second transistor is coupled to a second end of the first capacitor and the compensation device, and a second electrode of the second transistor is coupled to a second power supply terminal, a control electrode of the third transistor is coupled to the second control signal line, the first electrode of the third transistor is coupled to the first end of the first capacitor, and a second electrode of the third transistor is coupled to the second power supply terminal.

5. The pixel driving circuit of claim 1, wherein the compensation device comprises a fourth transistor, a fifth transistor and a second capacitor, wherein a control electrode of the fourth transistor is coupled to the third control signal line, a first electrode of the fourth transistor is coupled to the turn-on voltage acquiring device, and a second electrode of the fourth transistor is coupled to a first electrode of the fifth transistor and a first end of the second capacitor, a control electrode of the fifth transistor is coupled to the fourth control signal line, the first electrode of the fifth transistor is coupled to the first end of the second capacitor, and a second electrode of the fifth transistor is coupled to the control electrode of the driving transistor, a second end of the second capacitor is coupled to the first electrode of the driving transistor.

6. The pixel driving circuit of claim 1, wherein the data writing device comprises a sixth transistor, wherein a control electrode of the sixth transistor is coupled to the third control signal line, a first electrode of the sixth transistor is coupled to a data line, and a second electrode of the sixth transistor is coupled to the control electrode of the driving transistor.

7. The pixel driving circuit of claim 1, the light-emitting controller comprises a seventh transistor, wherein a control electrode of the seventh transistor is coupled to the light-emitting control signal line, a first electrode of the seventh transistor is coupled to a first power supply terminal, and a second electrode of the seventh transistor is coupled to the first electrode of the driving transistor.

8. The pixel driving circuit of claim 4, wherein the compensation device comprises a fourth transistor, a fifth transistor and a second capacitor, wherein a control electrode of the fourth transistor is coupled to the third control signal line, a first electrode of the fourth transistor is coupled to the first electrode of the second transistor, and a second electrode of the fourth transistor is coupled to a first electrode of the fifth transistor and a first end of the second capacitor, a control electrode of the fifth transistor is coupled to the fourth control signal line, the first electrode of the fifth transistor is coupled to the first end of the second capacitor, and a second electrode of the fifth transistor is coupled to the control electrode of the driving transistor, a second end of the second capacitor is coupled to the first electrode of the driving transistor.

9. The pixel driving circuit of claim 8, wherein the data writing device comprises a sixth transistor, wherein a control electrode of the sixth transistor is coupled to the third control signal line, a first electrode of the sixth transistor is coupled to a data line, and a second electrode of the sixth transistor is coupled to the control electrode of the driving transistor.

10. The pixel driving circuit of claim 9, the light-emitting controller comprises a seventh transistor, wherein a control electrode of the seventh transistor is coupled to the light-emitting control signal line, a first electrode of the seventh transistor is coupled to a first power supply terminal, and a second electrode of the seventh transistor is coupled to the first electrode of the driving transistor.

11. The pixel driving circuit of claim 10, wherein each of transistors in the pixel driving circuit is a P-type transistor.

12. A display apparatus comprising the pixel driving circuit of claim 1.

13. A display apparatus comprising the pixel driving circuit of claim 2.

14. A display apparatus comprising the pixel driving circuit of claim 3.

15. A display apparatus comprising the pixel driving circuit of claim 4.

16. A display apparatus comprising the pixel driving circuit of claim 10.

17. A display apparatus comprising the pixel driving circuit of claim 11.

18. A driving method of a pixel driving circuit, the pixel driving circuit is the pixel driving circuit of claim 1, the method comprises a turn-on voltage acquiring stage, a data writing stage, a threshold compensation stage and a display stage, wherein in the turn-on voltage acquiring stage, the turn-on voltage acquiring device acquires the turn-on voltage under the control of the first control signal and the second control signal, and generates the compensation signal according to the turn-on voltage;

in the data writing stage, the turn-on voltage acquiring device provides the compensation signal to the compensation device, and the data writing device provides the data voltage to the gate of the driving transistor under the control of the third control signal;

in the threshold compensation stage, the compensation device generates the control signal according to the compensation signal, the data voltage and the threshold voltage of the driving transistor under the control of the third control signal and the fourth control signal;

in the display stage, the compensation device provides the control signal to the driving transistor, the light-emitting controller provides the first operating voltage to the first electrode of the driving transistor under the control of the light-emitting control signal, the driving transistor generates the driving current under a combined action of the first operating voltage and the control signal to drive the light emitting device to emit light.

19. The driving method of claim 18, the turn-on voltage acquiring device comprises a first transistor, a second transistor, a third transistor and a first capacitor, a control electrode of the first transistor is coupled to the first control signal line, a first electrode of the first transistor is coupled to the second electrode of the driving transistor and the first electrode of the light emitting device, and a second electrode of the first transistor is coupled to a first end of the first capacitor and a first electrode of the third transistor, a control electrode of the second transistor is coupled to the first control signal line, a first electrode of the second transistor is coupled to a second end of the first capacitor and the compensation device, and a second electrode of the second transistor is coupled to a second power supply terminal, a control electrode of the third transistor is coupled to the second control signal line, the first electrode of the third transistor is coupled to the first end of the first capacitor, and a second electrode of the third transistor is coupled to the second power supply terminal, wherein the turn-on voltage acquiring stage includes a first sub-stage, a second sub-stage and a third sub-stage, and wherein in the first sub-stage, the light-emitting controller provides a first operating voltage to the first electrode of the driving transistor under the control of the light-emitting control signal, the driving transistor outputs a driving current, and the light emitting device is turned on; the first transistor, the second transistor are turned on under the control of the first control signal, and the third transistor is turned off under the control of the second control signal, the turn-on voltage of the first electrode of the light emitting device is written to the first end of the first capacitor through the first transistor, and the second operating voltage is written to the second end of the first capacitor through the second transistor, in the second sub-stage, the light-emitting control device stops providing the first operating voltage to the first electrode of the driving transistor, the first transistor and the second transistor are maintained being turned on under the control of the first control signal, and the third transistor is maintained being turned off under the control of the second control signal, in the third sub-stage, the first transistor and the second transistor are turned off under the control of the first control signal, the third transistor is turned on under the control of the second control signal, the second operating voltage is written to the first end of the first capacitor through the third transistor, and the second end of the second capacitor provides the compensation signal to the compensation device, a voltage of the compensation signal is equal to Vss−Voled, where Vss is the second operating voltage and Voled is the turn-on voltage.

20. The driving method of claim 19, the compensation device comprises a fourth transistor, a fifth transistor and a second capacitor, a control electrode of the fourth transistor is coupled to the third control signal line, a first electrode of the fourth transistor is coupled to the first electrode of the second transistor, and a second electrode of the fourth transistor is coupled to a first electrode of the fifth transistor and a first end of the second capacitor, a control electrode of the fifth transistor is coupled to the fourth control signal line, the first electrode of the fifth transistor is coupled to the first end of the second capacitor, and a second electrode of the fifth transistor is coupled to the control electrode of the driving transistor, a second end of the second capacitor is coupled to the first electrode of the driving transistor; the data writing device comprises a sixth transistor, a control electrode of the sixth transistor is coupled to the third control signal line, a first electrode of the sixth transistor is coupled to a data line, and a second electrode of the sixth transistor is coupled to the control electrode of the driving transistor; the light-emitting controller comprises a seventh transistor, a control electrode of the seventh transistor is coupled to the light-emitting control signal line, a first electrode of the seventh transistor is coupled to a first power supply terminal, and a second electrode of the seventh transistor is coupled to the first electrode of the driving transistor, wherein in the compensation stage, the third control signal line is controlled so that the fourth transistor is turned on and the data writing device is turned on; the first control signal line, the second control signal line, the fourth control signal line and the light emitting control signal line are controlled so that the first transistor, the second transistor, the third transistor, the fifth transistor and the light emitting controller are turned off, and in the display stage, the fourth signal control signal line and the light-emitting control signal line are controlled so that both the fifth transistor and the seventh transistor are turned on; the first control signal line, the second control signal line, the third control signal line and the fourth control signal line are controlled so that the first transistor, the second transistor, the third transistor, the fourth transistor and the sixth transistors are turned off.

* * * * *